US006041627A

United States Patent [19]

Buckland

[11] Patent Number: 6,041,627

[45] Date of Patent: Mar. 28, 2000

[54] COMPRESSION LATCH

[76] Inventor: Stuart Buckland, Flapgate, Cowall, Malvern, Worcestershire WR13 6HL, United Kingdom

[21] Appl. No.: 09/166,754

[22] Filed: Oct. 5, 1998

[51] Int. Cl.[7] ..... E05B 65/44

[52] U.S. Cl. ..... 70/78; 70/68; 70/84; 70/208; 292/DIG. 60

[58] Field of Search ..... 70/68, 208, 77–84, 70/181–187, 451, 461; 292/62–65, 336.3, DIG. 51, DIG. 60, 61, 58, 66, 67

[56] References Cited

U.S. PATENT DOCUMENTS

| | | | |
|---|---|---|---|
| 2,086,034 | 7/1937 | Jacobi | 70/84 X |
| 3,691,799 | 9/1972 | Hoffmann et al. | 70/84 |
| 4,262,502 | 4/1981 | Oda | 70/68 |
| 4,403,485 | 9/1983 | Scherbing | 70/68 |
| 4,494,781 | 1/1985 | Lafosse | 70/79 X |
| 4,556,244 | 12/1985 | Bisbing | 292/65 |
| 4,583,775 | 4/1986 | Bisbing | 292/64 |
| 4,623,177 | 11/1986 | McKinney | 292/DIG. 60 X |
| 4,763,935 | 8/1988 | Bisbing | 292/DIG. 60 X |
| 4,871,278 | 10/1989 | Gerlach et al. | 292/64 X |
| 4,878,367 | 11/1989 | Bisbing | 70/491 |
| 4,911,489 | 3/1990 | Hansen et al. | 292/DIG. 60 X |
| 5,076,080 | 12/1991 | Fuss et al. | 70/208 X |
| 5,165,738 | 11/1992 | McCormack | 292/67 |
| 5,596,894 | 1/1997 | Lee | 70/181 X |

*Primary Examiner*—Suzanne Dino Barrett

[57] ABSTRACT

A latch of the pull-up type for attaching one member to another, such as cabinet door to a cabinet, is unlatched and latched by turning the latch handle in one direction or the other. When the door is in a latched position, rotating the unlatching direction initially causing a spring-biased member carrying a latching pawl to move axially inward and away from the engaging surface. The inward movement of the shaft is permitted because a cam in the latch body is moved rotationally to present downwardly sloping cam surfaces of second cam member. An adjustable pawl member is provided which can be positioned to operate over a range of distances relative to the latch body.

30 Claims, 10 Drawing Sheets

COMPRESSION LATCH

BACKGROUND OF THE INVENTION

1. Field of the Invention

This invention relates to the field of latches, and more particularly to latches for a panel or cabinet closure.

2. Brief Description of the Prior Art

A variety of pull-up latches are known for a latching action which is achieved by drawing a clamping member against the inside of a cabinet surface or keeper member mounted on the cabinet surface. Generally, a keeper is mounted to a cabinet, and a clamping member of the latch, which is mounted on a panel closure, engages the keeper and draws the panel closure closer to the cabinet when the latch is pulled or actuated.

Other latches are known where a pawl is rotated about an axial plane to engage a keeper member.

There are also latches, such as those in U.S. Pat. No. 4,878,367 "Binary Coded Key and Latch-Actuator" and U.S. Pat. No. 4,556,244 "Latch Assembly Having Pull-Up Action", the complete disclosure of which is herein incorporated by reference, in which a latch is turned to rotate a pawl and, upon further turning, to move the pawl along an axis.

SUMMARY OF THE INVENTION

The present invention provides a novel compression latch which can be used to secure a first member to a second member, such as, for example, a panel closure member to a cabinet. The latch may have a locking means which can be actuated with a key, tool or other member for turning the latch to engage and disengage a keeper or other member that secures the latch pawl. Additionally, a handle may be provided in place of a key or tool actuator for securing and releasing the latch, or a handle may be provided in conjunction with a key or other locking means. The actuation of the latch includes a radial rotation of the pawl and an axial displacement of the pawl. The pawl movement preferably takes place during a single continuous turning motion of the latch handle.

The latch of the present invention can be further provided with an adjustment mechanism which includes a slip-fit pawl engagement member which can be installed to occupy a range of positions along the direction of the shaft or axis of the latch. This feature provides the latch of the present invention with the ability to operate on, or with, panels having different thicknesses, or where the cabinet or keeper member is at different locations relative to the latch.

The pawl of the present invention can be provided to have configurations which enable use of the latch with cabinet panels of different dimensions, such as spacings and thicknesses. For, example, the pawl can extend various lengths from the latch body. This can be done by providing different pawls which can work in conjunction with the other components of the latch. A removably provided pawl member can be employed. The pawl member, in addition to being adjustable, can be replaceable. For example, if a cabinet is changed to require that a pawl extend further to one lateral direction, a pawl extending radially less or greater from the latch body can be employed, while permitting the latch body to remain installed. This even can compensate for mistakes, for example, where bore holes for the latch body are mispositioned, or where an existing hole is present from a prior latch and it is desirable to use that hole for replacement with the present latch.

It is an object of the present invention to provide a novel latch assembly where a pawl is rotated and axially moved for engagement with, and disengagement from, a keeper member or surface.

Another object of the present invention is to provide a latch which can close over a range of positions to provide regulation of the gripping or latching force used to secure panels together, and a wider gripping range.

Another object of the present invention is to provide a latch which has gripping action throughout an axial range of movement of a pawl.

It is another object of the present invention to accomplish the above objects by providing a novel latch which is resistant to dust and debris.

Another object of the present invention is to provide a latch which can be constructed by snap-fit installation of the component parts.

It is another object of the present invention to provide an adjustable latch which can facilitate the replacement of existing latches in existing panel bores.

It is a further object of the present invention to accomplish the above objects by providing an adjustable pawl member.

A further object of the present invention is to provide a novel latch which has replaceable pawl members.

It is a further object of the present invention to provide a latch assembly, wherein the components can comprise a plastic material.

BRIEF DESCRIPTION OF THE DRAWING FIGURES

DETAILED DESCRIPTION OF THE PREFERRED EMBODIMENTS

Figure 1:
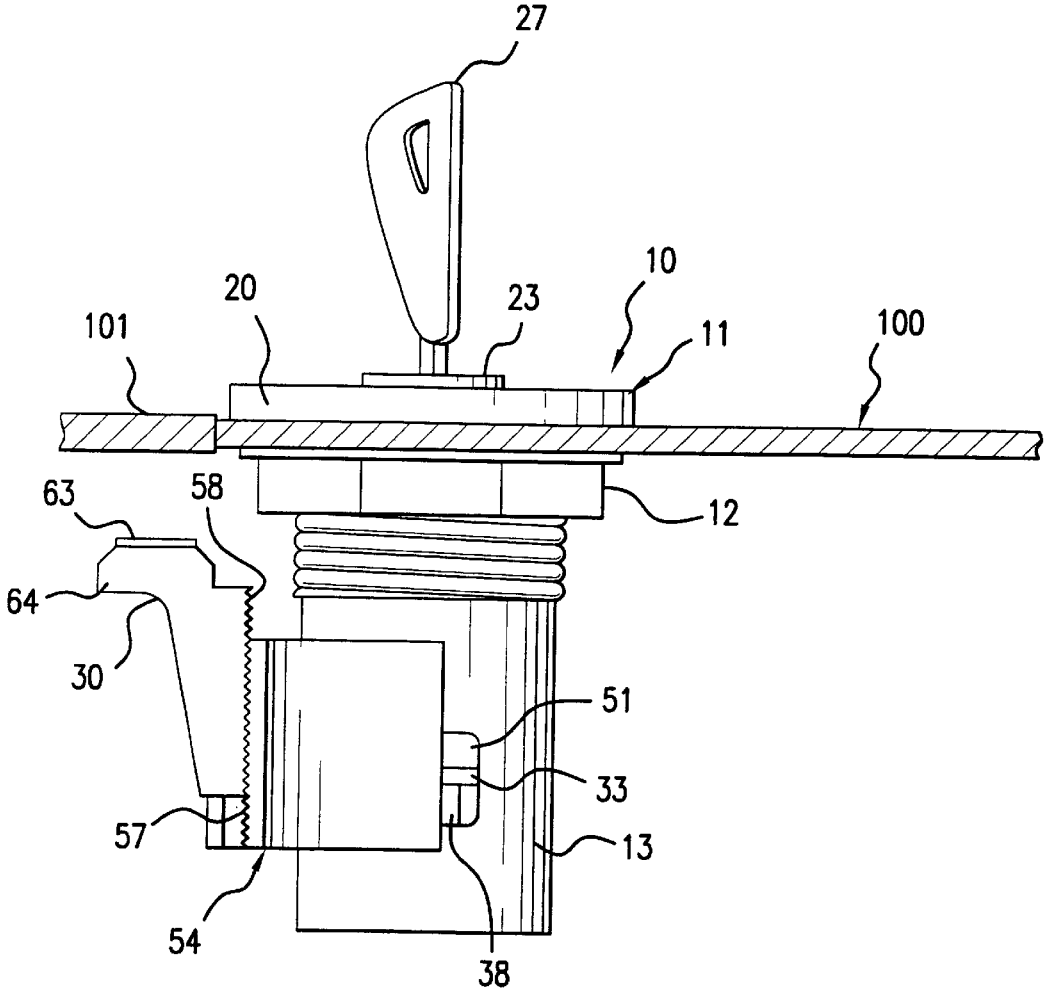
FIG. 1 is a front elevation view of a latch according to the present invention shown installed on a closure panel of a cabinet.

Referring to FIG. 1, a preferred embodiment of a fastening assembly 10 according to the present invention is shown mounted on a first member or mounting surface, such as the panel 100. A keeper, such as the cabinet panel 101, is also shown, and it will also be understood that the keeper may also comprise a member which can be mounted on the cabinet panel 101. The fastening assembly 10 has a latch body which is shown comprising lock plug housing 11, and an outer housing 13, and also includes a retaining member 12. The outer housing 13 is shown having a cylindrical body with a bore there through 14 which receives elements of the fastening assembly 10 therein. Preferably, the lock plug housing 11 is mounted in the outer housing 13. The outer housing 13 further has mounting means for mounting the latch 10 to a panel 100. Threads for attachment of the retaining member 12 are shown provided on the outer housing 13. The retaining member 12 when tightened on the outer housing threads, compresses the outer housing flange 20 against the panel 100 to secure the latch 10 in place.

Figure 2:
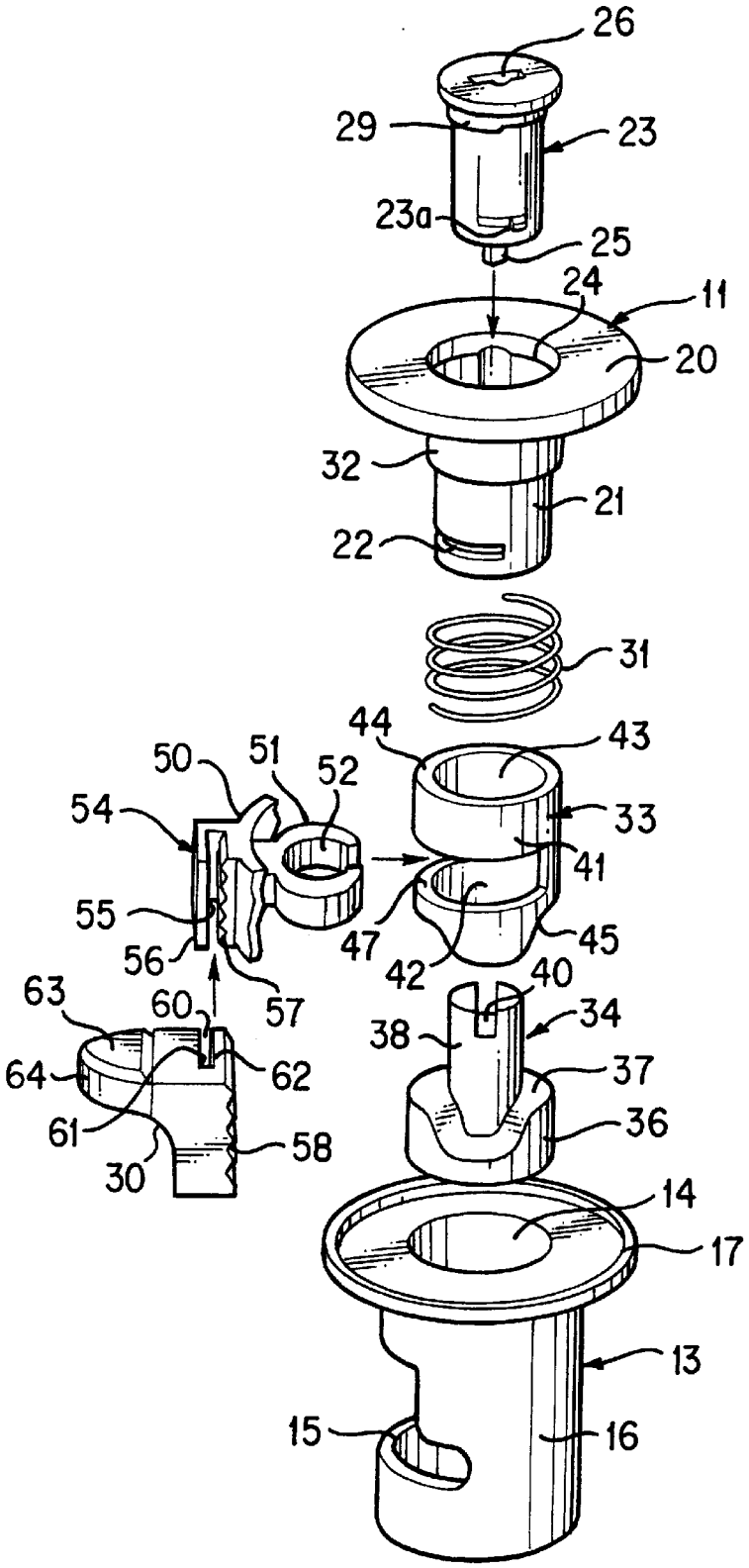
FIG. 2 is an exploded view of the latch of FIG. 1.

As shown in the exploded view of FIG. 2, the outer housing 13 is also provided with a notch 15 in the cylindrical wall portion 16 thereof. A collar portion 17 is also provided on the outer housing 13. The lock plug housing 11 is shown having an upper flange 20 from which extends a body portion 21 which has a slot 22 disposed partially about its outer cylindrical periphery. The lock plug housing 11 can receive a lock plug 23 therein, as shown, or optionally can have a handle, screw slot or other like suitable operator. A bore 24 is provided in the lock plug housing 11 and has an inner surface which is defined in part by the flange portion 20 and the inner cylindrical surface of the body portion 21. The lock plug 23 is inserted into and mounted in the lock plug housing 11. This can be done by snap-fit installation, such as providing each of the housing bore 24 and the plug 23 with one of a groove and ridge for attachment of said lock plug 23 to the housing 11. Preferably. As shown in FIG. 2, the lock plug 23 includes a locking member 23*a* which is received within the slot 22 of the lock plug housing 11 to retain the lock plug 23 therein. The lock plug 23 also has actuating means, shown comprising a tab 25 extending from the lock plug 23, and a slot 26 for receipt of a key 27 (FIG. 1) therein. The key 27 permits the latch 10 to be actuated by rotating the key 27 to engage and disengage the latch pawl 30 with an engaging surface, such as a keeper, cabinet, panel or other like member.

While a key actuation means is shown in FIG. 2, it is understood that other suitable actuation members may be substituted therefor, such as a screw head slot which can be used with a screw driver, a handle, or another suitable tool member which can be rotated with a matingly supplied tool.

The fastening assembly 10 is further provided with a compression spring 31 which is received on the body portion 21 of the housing 11. A lip 32 is provided on the body portion 21 to act as a stop against which the compression spring 31 is compressed. The body portion 21 of the lock plug housing 11 along with an upper cam 33, a lower cam 34 and the spring 31 are carried within the bore 14 of the outer housing 13. The outer housing 13 is also provided with a bottom surface 35 on which the lower cam 34 is seated. The lower cam 34 has a lower portion 36 with a camming surface 37 thereon and a spindle member 38 extending upwardly therefrom. The spindle member 38 is shown having a generally cylindrical configuration with a horizontal notch 40 extending into the upper portion thereof. The notch 40 is shown comprising a generally unshaped, cut-out portion extending diametrically through the upper cylindrical surface of the spindle member 38. The notch 40 is further matingly provided to engage the tab 25 of the lock plug 23. The lower cam 34 is therefore rotated along with the tab 25 of the lock plug 23 when the key 27 is rotated. The upper cam 33 is shown having a cylindrical body portion 41 with a pawl carrier slot 42 disposed in a portion of the cylindrical body 41. The upper cam member 33 has a bore 43 disposed there through which communicates with the pawl carrier slot 42. The upper cam 33 is also provided with an upper edge 44 against which the compression spring 31 engages. The upper cam 33 also includes a cam engaging portion 45 which is provided on the lower end thereof opposite the upper edge 44. The cam engaging end 45 is provided with a following surface 46 which engages the camming surface 37 of the lower cam 34 and follows the camming surface 37 throughout a partial arc of the rotation of the key 27, or other operator. The notch 42 of the upper cam 33 can also be defined in part by a ledge 47.

The fastening assembly 10 includes a pawl carrier 50 which has means connecting it to the upper cam 33. The connecting means is shown comprising an arm 51 by which the pawl carrier 50 connects to the upper cam 33. The pawl carrier arm 51 is shown having a slot 52. When the latch is assembled, the spindle 38 of the lower cam 34 extends through the slot 52 and may be engaged by the pawl carrier arm 51, as the pawl carrier 50 and upper cam 33 to which it is attached are raised or lowered by the camming surface 37. The pawl carrier 50 also comprises pawl adjusting means, shown comprising the pawl carrying arm 54. The carrying arm 54 has a slot 55 defined on one side by a wall portion 56 and on the other by series of grooves 57. The pawl 30 is provided with attachment means for connecting the pawl 30 to the pawl carrier 50. The attachment means are configured such that the pawl 30 may be readily removed and replaced on the pawl carrier 50. Positioning means are further provided to adjust the relative position of the pawl 30 with respect to the latch. The pawl 30 is shown having an engaging surface 58 with grooves disposed thereon which provide a mating surface for engaging the grooves 57 of the pawl carrier arm 54. The pawl 30 is further provided with a connecting slot 60 which is defined by a first wall 61 and an opposing wall 62. The connecting slot 60 is provided to receive the wall portion 56 of the pawl carrier therein to facilitate attachment of the pawl 30 to the pawl carrier 50. The pawl 30 also is provided with means for engaging a cabinet, keeper or other suitable member against which the latch is compressed, for securing first and second members or panels together. The engaging member is shown comprising a foot 64 having an engaging surface 63 thereon. The engaging surface 63 can also engage the panel 100 as well as the cabinet 101.

The adjustment means permits the pawl 30 to be provided along different positions of the vertical span of the pawl carrier 50 to accommodate panel, cabinet, or keeper member thicknesses of varying depth. The adjustment means further provides means for attenuating the force with which the latch 10 holds a first member to a second member, or, for example, a closure panel 100 to a cabinet 101. The pawl 30, can also be provided comprising varying configurations, which can be employed by replacing the pawl 30 on the latch as needed.

The latch 10 of the present invention is operated by rotating the key 27 from a latching position to an unlatched position. In the closing operation of the latch, starting from an open position, when the key 27 is rotated, the pawl carrier 50 and pawl 30 carried thereon, are also rotated in the direction of the key 27 there along with. This rotation of the key 27 is carried out until a predetermined amount of rotation has taken place. The rotation is generally a partial radial rotation, wherein during the first part of the rotation the pawl 30 moves behind the keeper. After the radial rotation of the pawl 30, the key 27 is further rotated, during which, the upper cam 33, which is connected to the pawl 30 and pawl carrier 50, follows the camming surface 37 of the lower cam member 34 to cause the upper cam 33 to undergo an axial displacement relative to the lower cam 34 and lock plug housing 11. This lifting of the upper cam 33 is against the natural bias of the spring 31, which exerts a relative force in the direction of the lower cam 34. The lifting of the upper cam 33 causes the pawl 30 and carrier 50 to be moved in the same direction, along the shaft 38 of the lower cam 34. The pawl 30 is thereby drawn inwardly, relative to the top or flange 20 of the lock plug housing 11, to engage the keeper member or keeper surface 101. This compression action is completed to latch the fastening member 10 in its closed position. The key 27 is thereafter removed to maintain the fastening assembly 10 in its locked condition.

Similarly, the unlatching of the fastening assembly 10 is accomplished by rotating the key 27 in the opposite direction, whereupon, the pawl 30 is released from the keeper, and is rotated away from the keeper to return to its unlocked position.

Figure 2A:
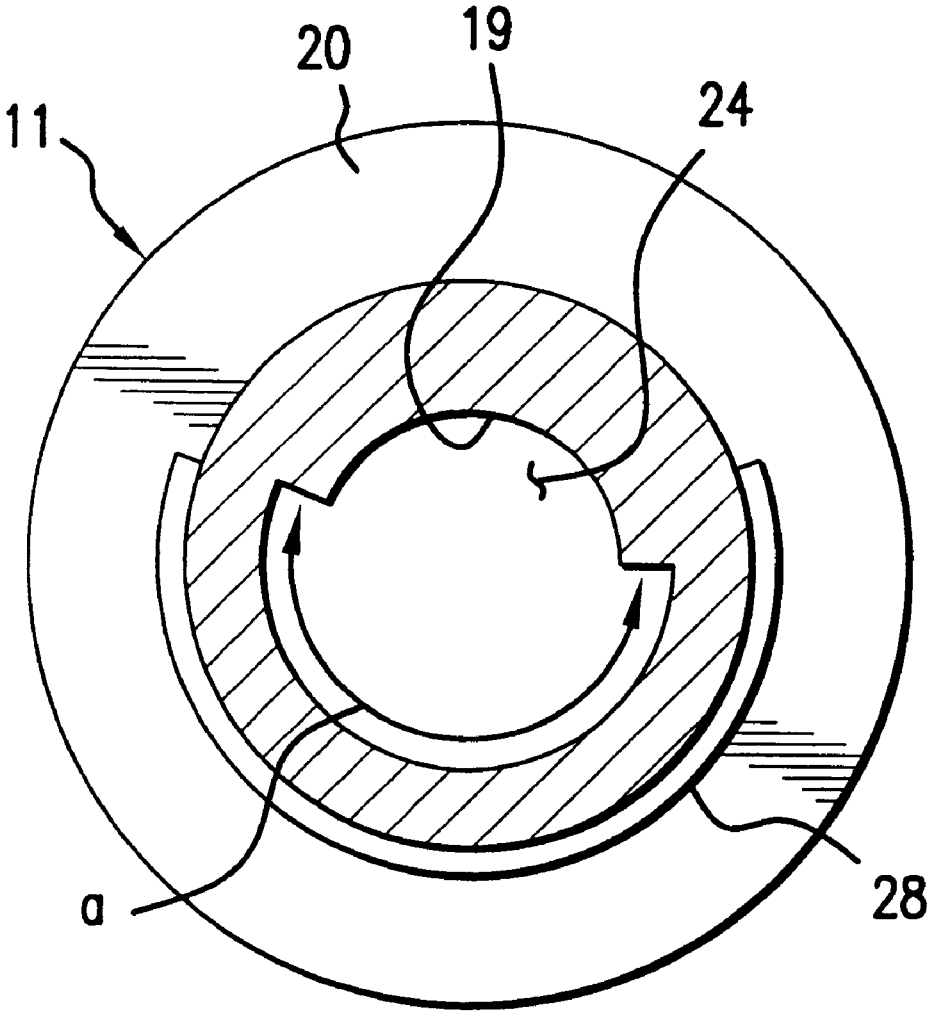
FIG. 2A is a bottom cross-sectional view of the lockplug housing of FIG. 1 taken along the line 2A—2A of FIG. 1.

Stop means is provided to stop the radial rotation of the pawl member 30. When the stop means is activated, the latch 10 can be operated by latching and unlatching. Conversely, when the stop means is deactivated, the latch 10 cannot be latched and unlatched. The stop means is shown in FIG. 2A comprising a protruding portion 19 which extends radially inwardly into the housing bore 24, and a tab portion 29 on the lockplug 23 (FIG. 2). The tab 29 rotates throughout a predefined arc indicated by double arrow "a" in FIG. 2A which is defined by the protruding portion 19. The protruding portion 19 operates to limit the movement of the pawl 30 to approximately 180°, as shown in FIG. 2A. The tab 29 is stopped by the protruding portion 19 at each end of arc "a" to limit the radial movement of the lockplug 23 relative to the outer housing 11. During the first 90° of lock plug movement, the pawl 30 is radially moved. The remainder of the lock plug movement, over the second 90° arc, causes the pawl 30 to undergo an axial displacement. The first 90° movement is terminated when the pawl carrier 54 is stopped by engaging the edge of the notch 15 of the outer housing 13. This limits the radial movement of the pawl 30 relative to the outer housing 13, and causes the axial movement to begin.

The rotation of the lock plug 23 which results in the radial movement of the pawl 30 is accomplished by the upper cam 33 and lower cam 34 moving together. When the notch or stop 15 is reached, the continued rotation of the lock plug 23 causes the lower cam 34 to engage the upper cam 33 to force the upper cam 33 upward, relative to the lower cam 34. The pawl 30 connected to the upper cam 34 is moved upward, (axially), into engagement with the cabinet or keeper 101. The key 27 can then be withdrawn from the lock plug 23 to allow the latch 10 to remain in its latched condition. A retaining collar 28 extends partially around the periphery of the lock plug housing 11 and is received in a mating groove (not shown) which is preferably provided in the outer housing 13 to prevent radial movement of the lock plug housing 11 within the outer housing 13.

Unlatching may be accomplished in a similar manner, by rotating the key 27 in the opposite direction to release the pawl 30 from engagement with the keeper 101, by axially moving the pawl 30. The rotation of the key 27 in the direction opposite of the latching direction turns the lower cam 34 in the same direction as the key 27, relative to the upper cam 33, until the pawl 30 is moved axially. When the pawl 30 is released and has moved axially, the continued rotation of the operator or key 27 causes the upper cam 34, which engages with the lower cam 33, to move with the lower cam 34. The upper cam 33 and lower cam 34, and pawl 30, are rotated with the operator to clear the pawl out of alignment with the keeper.

Figure 3:
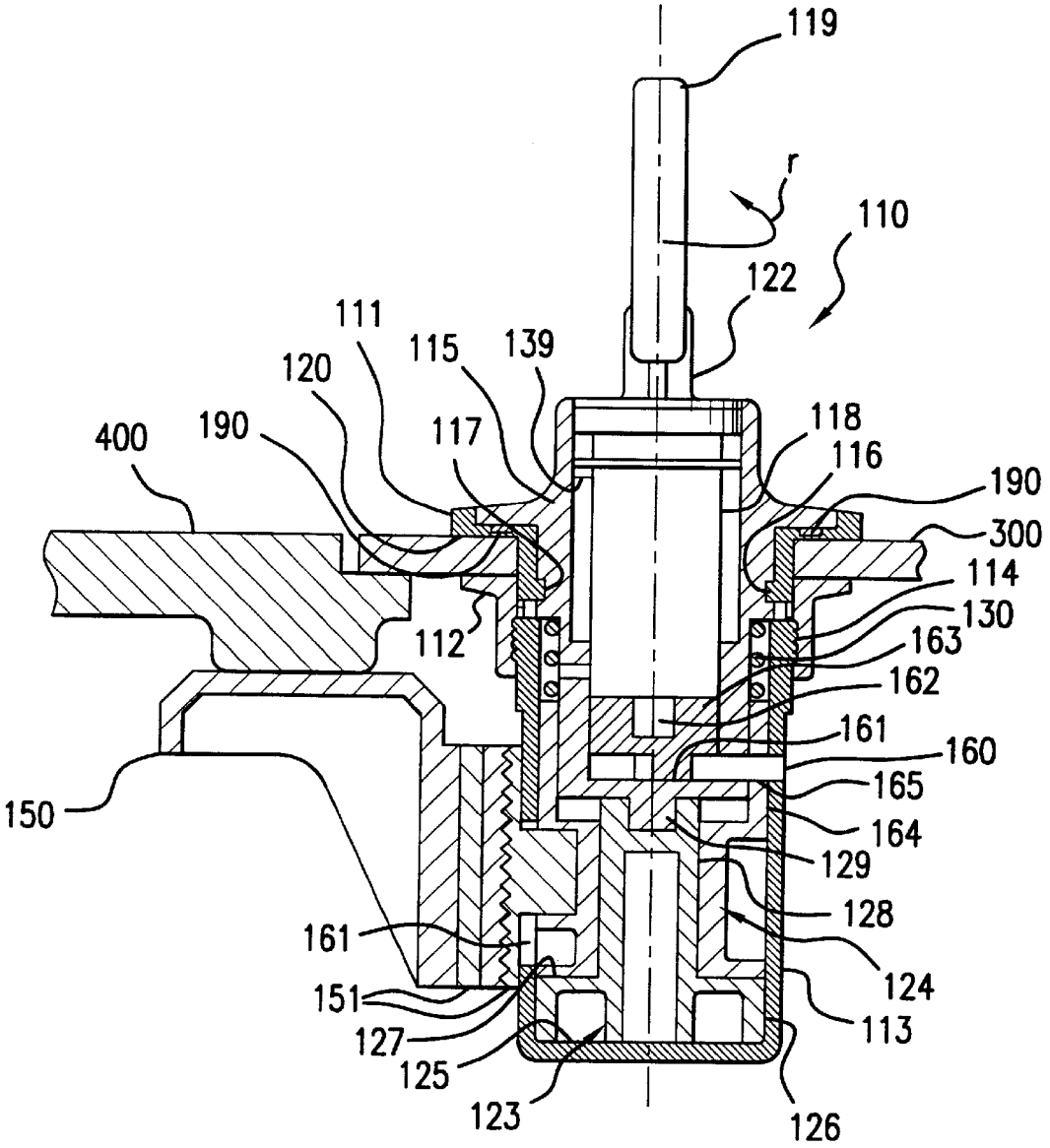
FIG. 3 is a longitudinal cross-sectional view of an alternate embodiment of a lath according to the present invention, shown in the locked condition.

An alternate embodiment of a latch 110 according to the present invention is shown in FIG. 3 installed on a first member, such as the panel 300 with a second member, such as the cabinet 400. The latch 110 has a latch body, shown comprising an upper or lock plug housing 111 and an outer housing 113 which are connected. The upper housing 111 is provided with means to retain the latch 110 on a closure member, such as the panel 300, which are shown comprising the threads 114 on its outer peripheral surface. A retaining member such as the nut 112 facilitates mounting of the latch 110 to a panel 300 by clamping the flange 120 of the latch upper housing 111 against the exterior surface of the panel 300.

The upper housing 111 is connected to the outer housing 113 with connecting means, which can comprise an annular groove on one surface and a flange on another surface which can be pressed into the groove to lock the upper housing and outer housing together. Alternately, barbs, threads, or other suitable attachment members can be employed to connect the upper and outer housings, respectively 111, 113.

An insert member 115 is shown attached to the upper housing 111 with suitable attachment means. The attachment means which holds the insert 115 to the upper housing 111 is shown comprising an annularly disposed ledge 116. The insert member 115 has an annular groove 117 which the ledge 116 engages. The insert member 115 can be snap-fit into the upper housing 111 and retained there with the annular ledge 116. The insert member 1 15 is rotatably connected to the upper housing 111 for relative rotation of the insert member 115. Additionally, the attachment means can comprise barbs, or other suitable connecting member (not shown), which can engage the groove 117 in a manner similar to the ledge 116, which will also permit rotation of the insert 115 relative to the upper housing 111. The insert member 1 15 receives a lock plug 118 and holds it within the insert member 115 with suitable attachment means, which can, for example, comprise a ledge and groove arrangement, such as that connecting the insert 115 with the upper housing 111. A key 119 is provided to actuate the latch 110 and fits within a slot 121 of the lock plug 118. As discussed above, although a key 119 is shown, the latch 110 can have other means for actuation, such as a screw slot, handle or other like operator.

Figure 4:
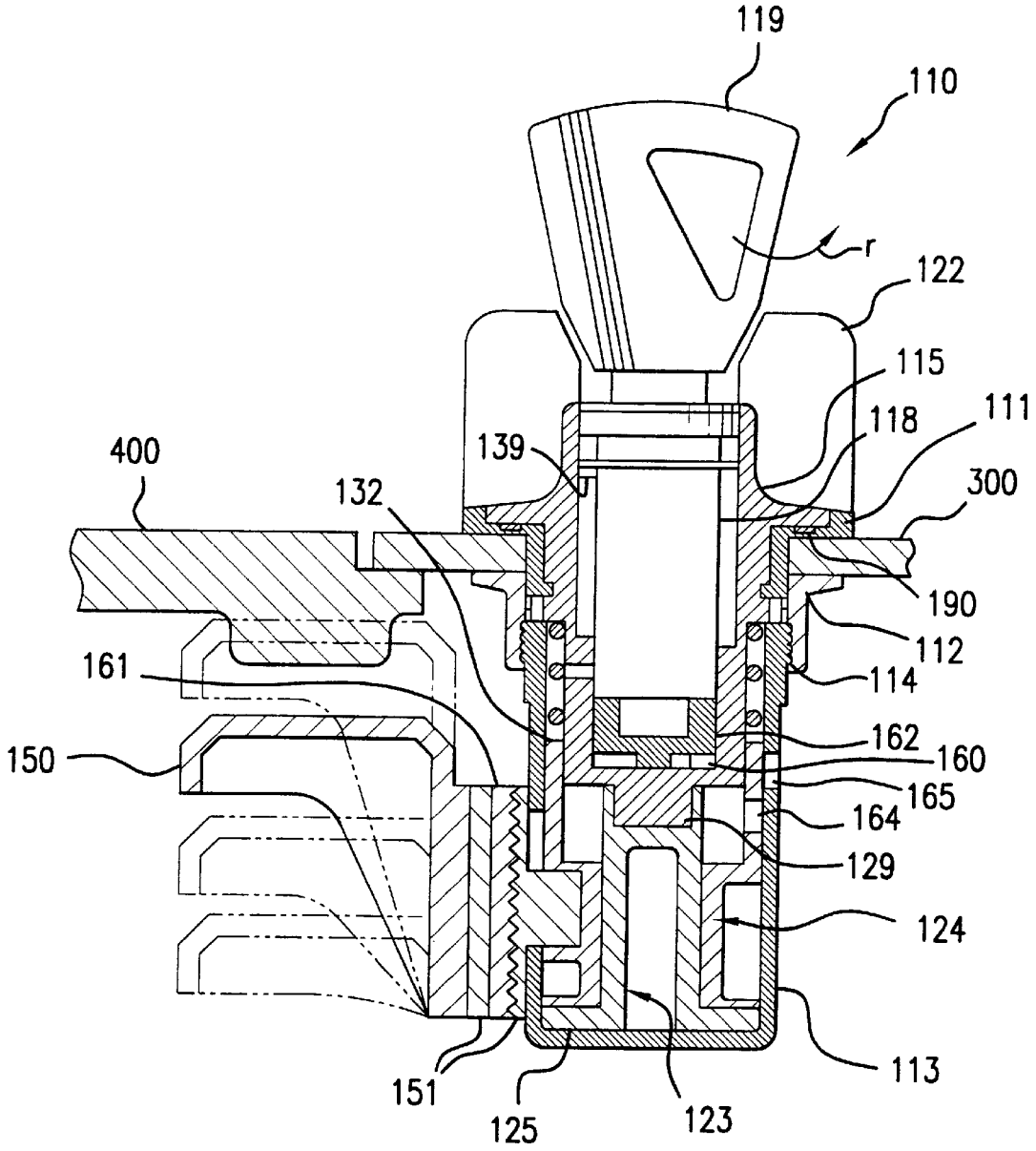
FIG. 4 is a longitudinal cross-sectional view of the latch unlocked, with the pawl in mid position.
Figure 4A:
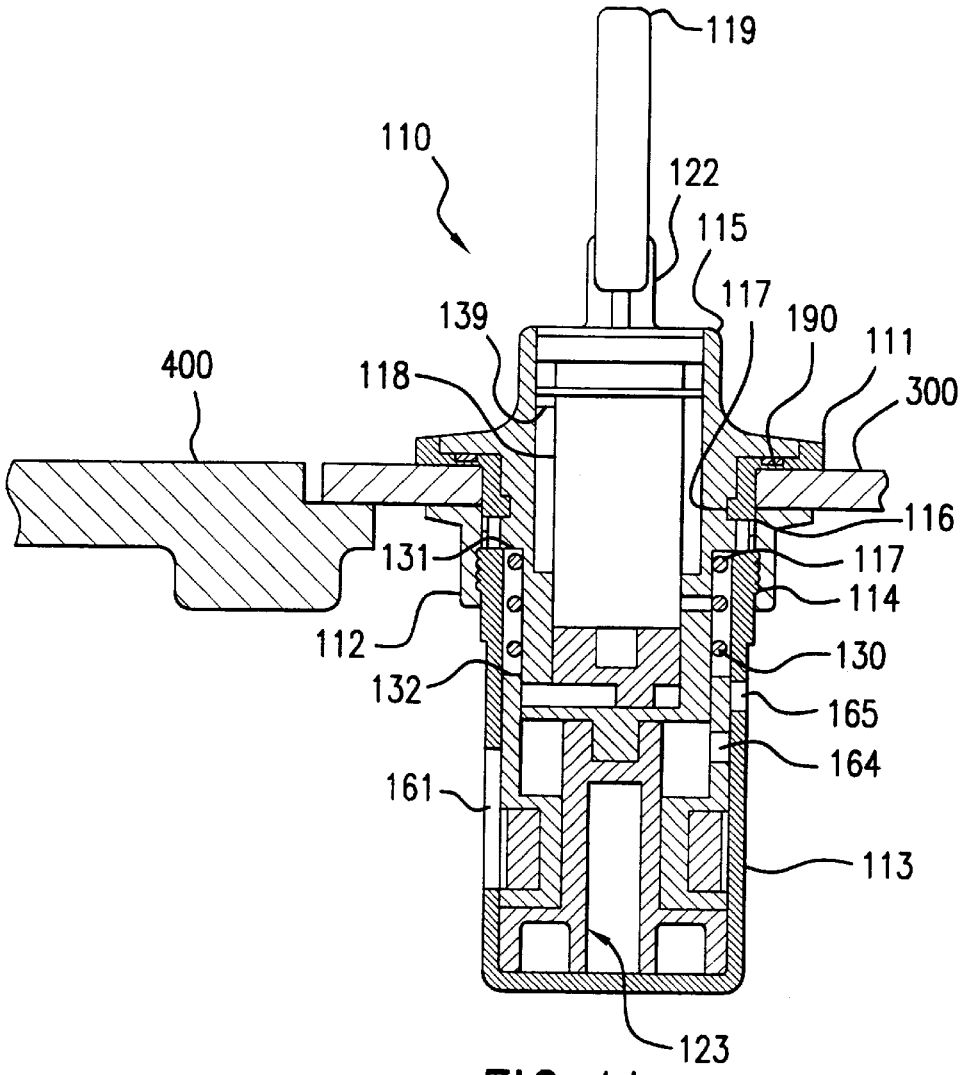
FIG. 4A is a longitudinal cross-sectional view of the latch of FIG. 3, shown in the unlocked condition, where the key and handle has been rotated 180 degrees in relation to the FIG. 3 position.

A lower cam member 123 and upper cam member 124 are carried within the outer housing 113. The lower cam 123 comprises a lower circumferential portion 126 with a camming surface 127 thereon and further having a spindle 128 extending upwardly therefrom. The camming surface 127 is uneven and permits axial movement of the upper cam 124 within the housing 113 when one of the upper cam member 124 and lower cam member 123 is rotated relative to the other. The lower cam 123 is seated on the outer housing floor 125. Biasing means is provided to bias the upper cam 124 into engagement with the camming surface 127 of the lower cam 123. The biasing means is shown comprising a spring member 130 disposed about the cylindrical periphery of the insert member 115. The spring member 130 is disposed between the spring retaining hub or flange 131 of the insert member 115 and the upper circumferential edge 132 of the upper cam 124. The upper cam 124 is shown in FIGS. 3 and 4 having a cylindrical body 135 with a slot 136 disposed therein extending partially around the circumference of the body 135.

Figure 5:
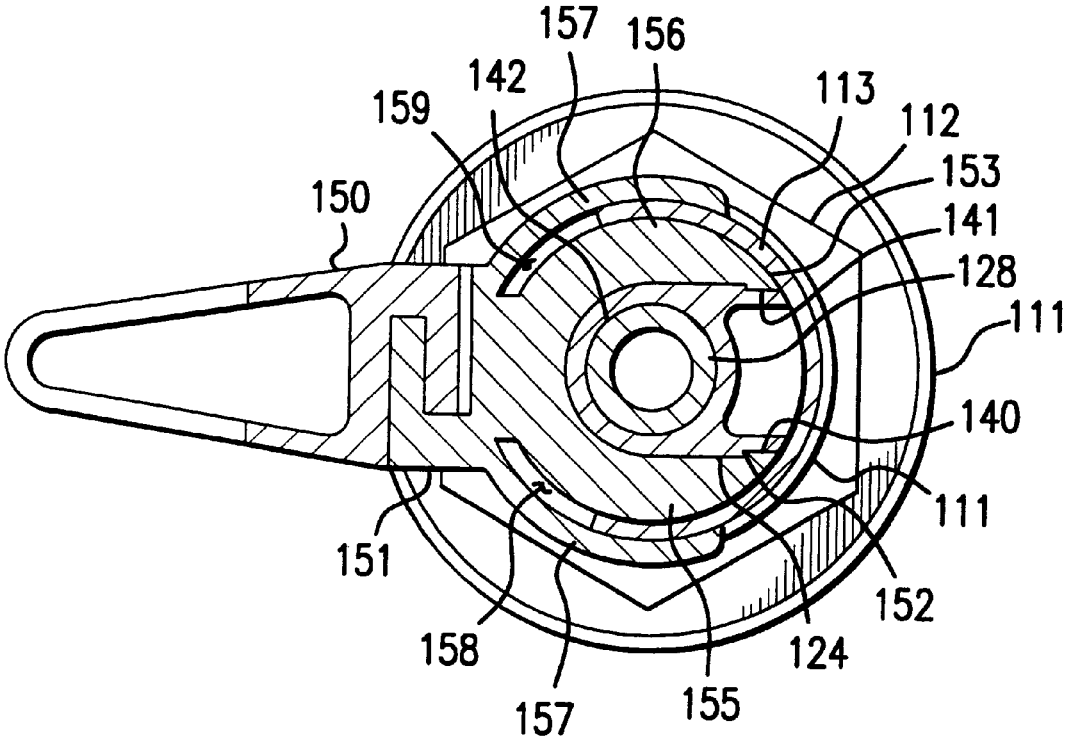
FIG. 5 is a horizontal sectional view of the latch of FIG. 3, taken along the line 5—5 of FIG. 3.

Connecting means is also provided to connect the pawl 150 (FIG. 3) to the upper cam 124 for movement therewith. Referring to FIG. 5, the pawl carrier 151 is shown connected to the upper cam 124 with the pawl 150 attached to the carrier 151. The pawl carrier 151 has means which permit it to rotate along a predetermined arc of the outer housing 113. Connecting means are shown comprising a pair of receiving grooves 140, 141 on the upper cam 124 into which projections 152, 153 provided on the fingers 155, 156 of the pawl carrier 151 are received to hold the carrier 150 on the upper cam 124. The upper cam 124 preferably has a sleeve or hollow bore 142 therein for receiving the spindle 128 of the lower cam 123. The pawl carrier 151 also has an outer flange 157 which, with the fingers 155, 156 of the pawl carrier 151, forms a pair of slots 158, 159 through which the wall of the outer housing 113 passes. Preferably, the flange 157 covers the opening 161 of the outer housing 113 as the pawl 150 and pawl carrier 151 are rotated radially about the outer housing 113 when the latch 110 is actuated for opening and closing. The flange 157 facilitates the prevention of dust and other debris, which could otherwise impede the latch operation, if permitted to enter the assembly. The opening 161 preferably comprises a slot having an axial dimension and a radial dimension, which can be provided as an L-shaped configuration, as shown in FIG. 2 with respect to the slot 15. The pawl carrier 151, as seen in FIGS. 3 and 4, extends through the slot 161.

Referring again to FIG. 3, the pawl carrier 151 is rotated along with the upper cam 124. When the handle 122 is turned, the lower cam spindle 128 is rotated to rotate the lower cam 123 and the upper cam 124 which is biased to engage the lower cam. 123. Locking means is provided, shown comprising the locking member 160 which extends radially outwardly from the insert member 115. While the locking member 160 is shown extending outward on one side, it will be evident that, while not shown, the locking member can also be provided to extend on diametrically opposite sides of the insert member 115 to secure the latch 110 from being opened or to prevent it from being locked. Preferably, the locking member 160 can be retracted with a key 119 to lock the latch 110 against further actuation. A locking cam shown comprising an eccentric member 162 is disposed in the insert member 115. The eccentric member 162 is keyed to rotate with the tab 163 of the lock plug 118 and engages the locking member 160. A cam slot 164 is provided extending through the upper cam 124 and a housing slot 165 is also provided in the outer housing 113. The lock plug 118 is turned with the key 119 to extend the locking member 160 outwardly through the cam slot 164 and into the outer housing slot 165, as shown in FIG. 3. In this position, the locking member 160 secures the assembly and prevents opening of the latch 110. Similarly, the unlocking of the latch 110 is accomplished by rotating the key 119, 180° in the direction of arrow "r", to retract the locking member 160 from the housing slot 165 and upper cam slot 164, as shown in FIG. 4. When the latch 110 is unlocked, the handle 122 can be turned to operate the latch 110.

Actuating means is provided to latch and unlatch the pawl 150 from engagement with a keeper member or surface 400. Actuating means is shown comprising a handle 122. The handle 122 is connected to the insert member 115 with attachment means, or preferably is provided as a one-piece single member integral with the insert member 115. The insert member 115 has engaging means, shown comprising the tab portion 129, which engages the spindle 128 of the lower cam 123 and rotates the lower cam 123 with the turning of the handle 122. The lower cam 123 and upper cam 124 are rotated together until the stopping means, shown comprising the slot 161, is engaged. When the stopping means is engaged, continued rotation of the handle 122 rotates the lower cam 123 to lift the upper cam 124 and pawl 150 carried thereby toward the keeper 400 for latching of the latch 110.

Figure 4B:
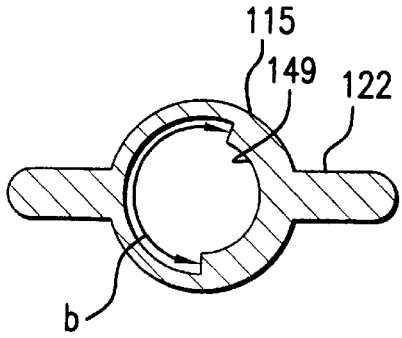
FIG. 4B is a cross-sectional view of the handle and lock plug housing of the latch shown in FIGS. 3, 4 and 4A, taken along the line 4A—4A of FIG. 4.

When the pawl carrier 151 comes into contact with an edge of the stopping means or "L" -shaped slot 161, the lower cam 123 will continue to rotate but the upper cam 124 will not and will therefore move upward toward the upper flange of the upper housing 111. As shown in FIG. 4B, the stopping means can further preferably comprise means for controlling the radial rotation of the lock plug 118. As described above, in relation to FIG. 2, the lock plug 118 can be provided with a protruding portion 139 which extends radially outward from the lock plug body. The protruding portion 139 can rotate in the directions indicated by double arrow "b" (FIG. 4B) within the bore of the insert member 115. The stop means can further include a stop member, shown in FIG. 4B comprising a thickened radial portion 149 of the insert 115 against which the protruding portion 139 of the lock plug 118 engages to limit relative movement between the lockplug 118 and the insert member 115. The stop means permits the pawl 150 to be moved in the axial direction upon further rotation of the handle 122, after the lock plug 118 has been rotated to reach the stop member 149. This further rotation of the handle 122, with the lock plug 118 now stationary relative to the insert 115, rotates the insert 115 and the lower cam 128 to displace the pawl 150 in an axial direction (toward the keeper when latching and away from the keeper when unlatching).

Reference being made to FIG. 4, wherein the latch 110 is shown with the handle 122 turned 90° in relation to the handle 122 position of FIG. 3. The pawl 150 is shown released from engagement with the cabinet panel 400, with the upper cam 124 being lowered in relation to the lower cam 123. From the FIG. 3 position, the handle 122is further rotated to move the pawl 150 along a radial arc of the outer housing 113 to clear the pawl 150 from engagement with the panel or cabinet 301 when the closure panel 300 on which the latch 110 is mounted is opened. The slot 161, as described above, is provided to limit the distance of rotation of the pawl 150. This enables the pawl positioning to be predetermined for alignment with a keeper member or surface 400.

The gripping of the pawl 150 with the keeper member or surface 400 can be accomplished over a range of positions of the pawl 150. As shown in FIG. 4, a gripping range, designated between the arrows "g"—"g" is indicated. The pawl 150 can grip a keeper surface throughout the gripping range. Alternately, the pawl 150 can be provided in alternate configurations, as shown in the broken-line embodiments of FIG. 4, for permitting latching of the latch 110 with the pawl accommodating keeper members or surfaces, generally 400, of differing depths relative to the latch body.

Figure 6:
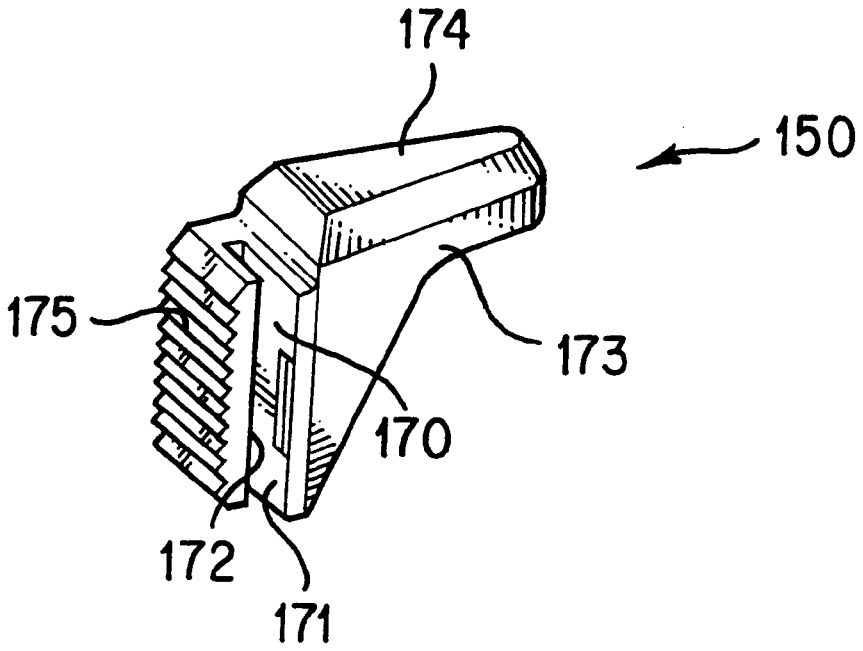
FIG. 6 is a parallel perspective view of a pawl according to the present invention.
Figure 7:
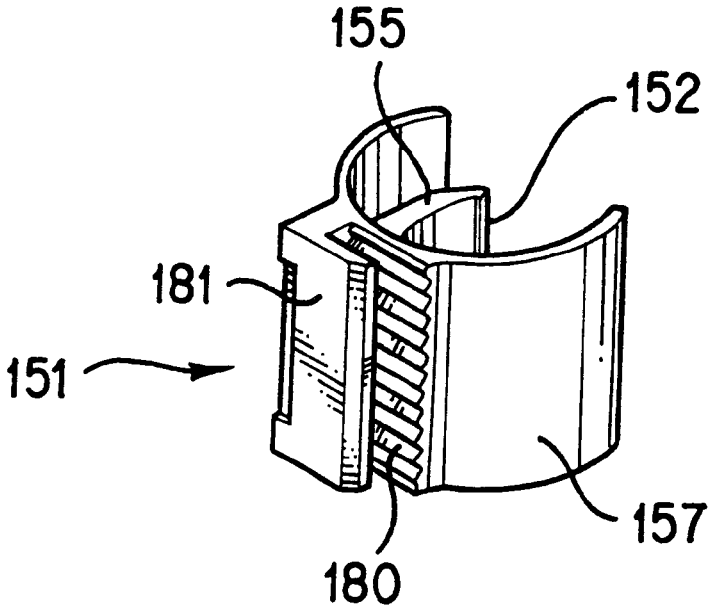
FIG. 7 is a parallel perspective view of a pawl carrier according to the present invention.

Reference now being made to FIG. 6, a pawl member 150 according to the present invention is shown. The pawl member 150 is provided with a connecting slot 170 defined by a first wall 171 and a second wall 172, and has a foot 173 with an engaging surface 174. A preferred embodiment of a pawl carrier 151 is shown in FIG. 7 with attachment means for connecting the pawl 150 to the carrier 151. The attachment means preferably comprises adjustment means, shown comprising a surface of ridges 180. The pawl member 150 has a mating surface of ridges 175 which engage the carrier ridges 180 when the pawl 150 is attached to the carrier 151. The carrier 151 has a connecting wall 181 which is received in the connecting slot 170 of the pawl member 150 when the pawl and carrier members are attached. The pawl ridges 175 and the carrier ridges 180 provide means for attaching the pawl 150 over the range of the carrier ridges 180 to position the pawl 150 at different locations.

Figure 8:
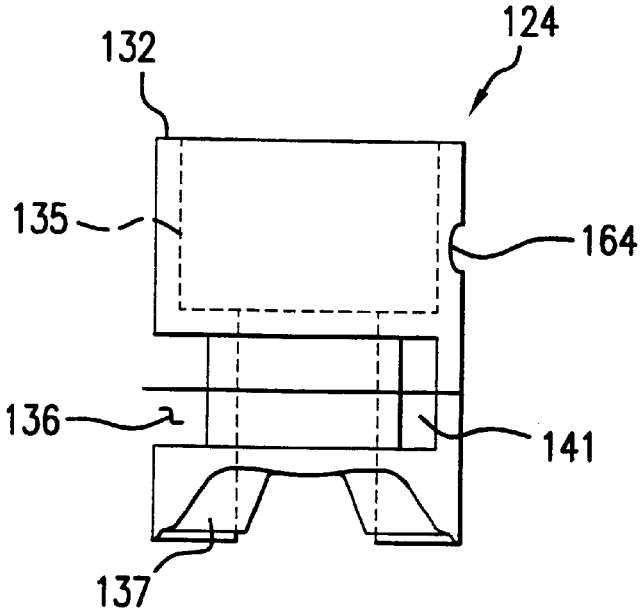
FIG. 8 is a front elevation view of the upper cam member of the latch of FIG. 3.
Figure 9:
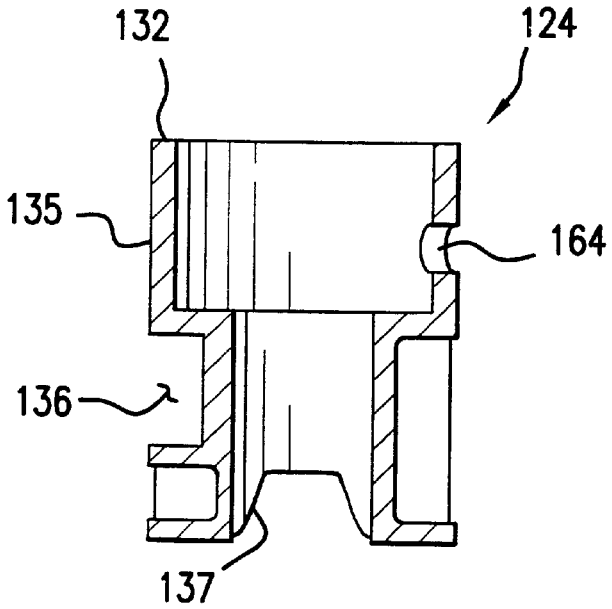
FIG. 9 is a longitudinal cross-sectional view of the upper cam of FIG. 8.
Figure 10:
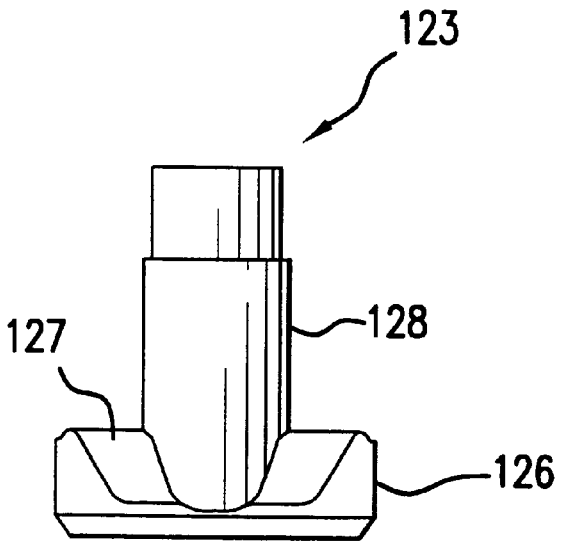
FIG. 10 is a front elevation view of the lower cam member of FIG. 3.
Figure 11:
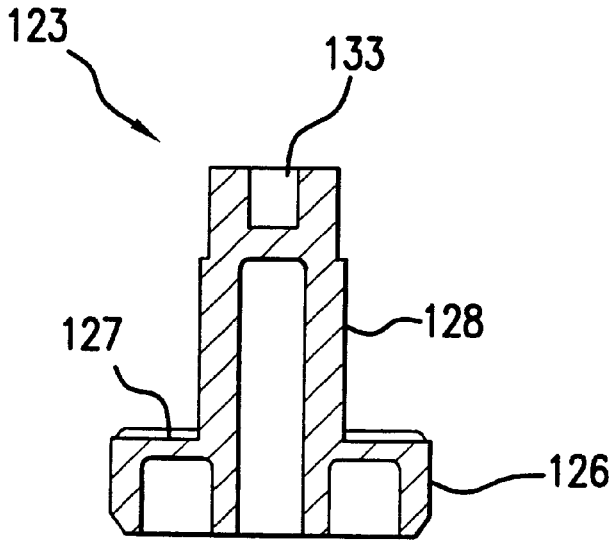
FIG. 11 is a longitudinal cross-sectional view of the lower cam member of FIG. 9.

Referring to FIGS. 8 and 9, the upper cam member 124 is shown comprising a cylindrical member 135 with a slot 136 disposed therein and having a lower following surface 137 for engagement with the camming surface 127 of the lower cam member 123. The lower cam member 123 is shown in FIGS. 10 and 11, with the circumferential portion 126, the spindle 128 extending upwardly therefrom, and having a camming surface 127. The lower cam 123 also has engaging means for engaging with the insert member 115. The engaging means is shown comprising a slot 133 which receives a tab 129 of the insert member 115.

The new latch has been shown mounted on a movable door panel, and it will be understood that the latch may be mounted on the fixed panel, or cabinet, rather than on the door. In addition, indicia of pawl location can be provided on the latch to indicate to the user the position of the pawl relative to the cabinet or keeper. These and other advantages of the present invention can be made consistent with the spirit and scope of the invention as disclosed in the Summary of the Invention, the Brief Description of the Drawing Figures, the Detailed Description of the Preferred Embodiments and the appended claims.

What is claimed is:

1. A pull-up latch wherein a pawl is moved both rotationally and axially to engage and disengage a keeper member or surface, the latch comprising:

a) a latch body having a generally cylindrical bore and being mounted to a first panel;

b) pawl means for engaging said keeper member or surface, said pawl means including a pawl and means to radially rotate said pawl and to axially move said pawl;

c) retaining means for retaining said pawl means on said latch, said retaining means comprising means for slidably and releasably connecting said pawl with said means to radially rotate said pawl and to axially move said pawl; and d) operating means for latching and unlatching the latch.

2. The latch of claim 1, wherein said means to radially rotate and axially move said pawl includes cam means.

3. The latch of claim 2, wherein said cam means includes a cam and a follower, said cam having a camming surface for raising and lowering said follower when said follower is moved relative to said cam.

4. The latch of claim 3, wherein said pawl means further comprises a pawl member which engages said keeper member or surface, said pawl member being connected to said follower.

5. The latch of claim 1, wherein said latch body comprises a first part and a second part and connecting means for connecting said first part and said second part.

6. The latch of claim 4, wherein said latch body further includes a slot, and wherein said cam and said follower are disposed in said cylindrical bore of said latch body, and wherein said pawl member connects to said follower through said slot.

7. The latch of claim 6, further comprising flange means for covering said slot.

8. The latch of claim 7, wherein said flange means rotates radially with said pawl member.

9. The latch of claim 2, further comprising stop means for stopping the radial rotation of said pawl member.

10. The latch of claim 9, further comprising lock means.

11. The latch of claim 10, wherein said lock means comprises means for activating and deactivating the stop means, wherein when the stop means is activated the latch can be latched and unlatched, and wherein when the stop means is deactivated, the latch cannot be latched and unlatched.

12. The latch of claim 10, wherein said lock means comprises a lock plug, and wherein said stop means comprises a tab radially disposed on said lock plug and engaging means disposed on said latch body which the tab engages to stop radial rotation of said pawl, said tab being radially rotatable throughout a range between engaging means.

13. The latch of claim 12, wherein said engaging means comprises means which when engaged by said tab stops further radial rotation of the pawl in a counterclockwise direction and means which when engaged by said tab stops radial rotation of said pawl in the clockwise direction.

14. The latch of claim 1, further comprising lock means.

15. A pull-up latch wherein a pawl is moved both rotationally and axially to engage and disengage a keeper member or surface, the latch comprising:

a) a latch body having a generally cylindrical bore and being mounted to a first panel, said latch body comprising a first housing part and a second housing part and connecting means for connecting said first housing part to said second housing part, said first housing part carrying operating means with which the latch can be latched and unlatched;

b) pawl means for engaging said keeper member or surface, said pawl means including a pawl member;

c) moving means to move said pawl means in radial and axial directions, said moving means comprising a first cam member and a second cam member disposed within the cylindrical bore of said second housing part, said pawl means being connected to said second cam member;

d) spring means disposed in the cylindrical bore of said latch body and biasing said second cam member into engagement with said first cam member;

e) wherein said operating means includes means engaging said first cam member for rotating said first cam member with said operating means;

f) stop means for stopping the radial rotation of said pawl means;

g) wherein said operating means is rotated to rotate said second cam member to radially rotate said pawl means for selectively positioning said pawl means into and out of alignment with said keeper member or surface, wherein the radial rotation of said pawl means is stopped with the stop means to align said pawl means with a keeper member or surface, and wherein said second cam member is rotated relative to said first cam member to follow the first cam member for axial displacement of the second cam member and pawl means into and out of engagement with a keeper member or surface; and h) wherein said first housing part comprises a cylindrical wall having a slot therein and wherein said pawl means connects with said second cam member through said slot.

16. The latch of claim 15, wherein said operating means includes actuating means and locking means.

17. The latch of claim 15, wherein said operating means comprises a handle.

18. The latch of claim 16, wherein said actuating means comprises a handle.

19. The latch of claim 18, wherein said locking means comprises a lock plug.

20. The latch of claim 16, wherein said locking means further comprises a locking member and an eccentric cam member, and holding means for holding said locking member, said holding means comprising a slot disposed in said second cam and a slot disposed in said latch body, the locking member being directed into and out of said holding means by rotating said eccentric cam.

21. The latch of claim 15, wherein said operating means includes an insert member rotatably mounted to said latch body and extending into said latch body and having means for rotating said insert member, said insert member having means engaging said first cam member.

22. The latch of claim 21, wherein said means for rotating said insert member comprises a handle.

23. In a latch assembly for securing a first member, such as a closure panel member, to a second member, such as a cabinet, wherein the latch has an operator for actuating the latch by latching and unlatching the latch to respectively secure and unsecure said first member to said second member, and a pawl member which undergoes at least one or more of an axial displacement and a radial rotation, wherein the improvement comprises a pawl member having a carrier portion which is connected to said latch, and an engaging portion which is removably connected to said carrier portion, wherein said carrier includes means for adjustably attaching said engaging portion over a range of axial positions along said carrier portion in relation to said latch body.

24. The apparatus of claim 23, wherein said carrier portion includes a connecting portion comprising a surface of ridges and grooves, and wherein said engaging portion includes a connecting portion comprising a mating surface of ridges and grooves.

25. The apparatus of claim 23, wherein said pawl member further includes a slot defined by a first wall and a second wall, and wherein said pawl carrier further includes a slot defined by a first wall and a second wall, wherein at least one pawl member wall is held in said carrier slot and wherein at least one carrier wall is held in said pawl member slot, wherein at least one of said first wall and said second wall of the pawl member has a surface of ridges, and wherein at least one of said first wall and said second wall of the pawl carrier has a mating surface of ridges, said pawl being attachable to said carrier by engagement of said pawl and carrier surface ridges, wherein said pawl is adjustably provided for attachment to said carrier throughout the range of the surface of ridges.

26. In a latch assembly for securing a first member, such as a closure panel member, to a second member, such as a cabinet, wherein the latch has an operator for actuating the latch by latching and unlatching the latch to respectively secure and unsecure said first member to said second member, and a pawl member which undergoes at least one or more of an axial displacement and a radial rotation, wherein the improvement comprises a pawl having a carrier portion which is connected to said latch, and an engaging portion which is removably connected to said carrier portion, wherein said carrier includes means for adjustably attaching said pawl over a range of positions along said carrier in relation to said latch body; wherein said pawl member further includes a slot defined by a first wall and a second wall, and wherein said pawl carrier further includes a slot defined by a first wall and a second wall, wherein at least one pawl member wall is held in said carrier slot and wherein at least one carrier wall is held in said pawl member slot, wherein at least one of said first wall and said second wall of the pawl member has a surface of ridges, and wherein at least one of said first wall and said second wall of the pawl carrier has a mating surface of ridges, said pawl being attachable to said carrier by engagement of said pawl and carrier surface ridges, wherein said pawl is adjustably provided for attachment to said carrier throughout the range of the surface of ridges.

27. A pull-up latch wherein a pawl is moved both rotationally and axially to engage and disengage a keeper member or surface, the latch comprising:

a) latch body having a generally cylindrical bore and being mounted to a first panel;

b) pawl means for engaging said keeper member or surface, said pawl means including a pawl and means to radially rotate said pawl and to axially move said pawl;

c) retaining means for retaining said pawl means on said latch;

d) operating means for latching and unlatching the latch;

e) wherein said means to radially rotate and axially move said pawl includes cam means;

f) wherein said cam means includes a cam and follower, said cam having a camming surface for raising and lowering said follower when said follower is moved relative to said cam;

g) wherein said pawl means further comprises a pawl member which engages said keeper member or surface, said pawl member being connected to said follower;

h) wherein said latch body comprises a first part and a second part and connecting means for connecting said first part and said s second part;

i) wherein said latch body further includes a slot, and wherein said cam and said follower are disposed in said cylindrical bore of said latch body, and wherein said pawl member connects to said follower through said slot; and j) wherein further comprising flange means for covering said slot.

28. The latch of claim 27, wherein said flange means rotates radially with said pawl member.

29. A pull-up latch wherein a pawl is moved both rotationally and axially to engage and disengage a keeper member or surface, the latch comprising:

a) a latch body having a generally cylindrical bore and being mounted to a first panel;

b) pawl means for engaging said keeper member or surface, said pawl means including a pawl and means to radially rotate said pawl and to axially move said pawl;

c) retaining means for retaining said pawl means on said latch;

d) operating means for latching and unlatching the latch;

e) wherein said latch body has a cylindrical outer wall with a slot therein, and wherein said pawl means extends through said slot, and f) sealing means for sealing said slot.

30. In a latch assembly for securing a first member, such as a closure panel member, to a second member, such as a cabinet, wherein the latch has an operator for actuating the latch by latching and unlatching the latch to respectively secure and unsecure said first member to said second member, and a pawl member which undergoes at least one or more of an axial displacement and a radial rotation, wherein the improvement comprises a pawl member having a carrier portion which is connected to said latch, and an engaging portion which is removably connected to said carrier portion, wherein said carrier includes means for adjustably attaching said engaging portion over a range of axial positions along said carrier portion in relation to said latch body; wherein said range of position includes a range of axial positions relative to said latch body; and wherein said carrier portion includes a connecting portion comprising a surface of ridges and grooves, and wherein said engaging portion includes a connecting portion comprises a mating surface of ridges and grooves.

* * * * *

UNITED STATES PATENT AND TRADEMARK OFFICE

CERTIFICATE OF CORRECTION

PATENT NO. : 6,041,627

DATED : March 28, 2000

INVENTOR(S) : Stuart Buckland

It is certified that error appears in the above-identified patent and that said Letters Patent is hereby corrected as shown below:

Column 8, line 37, "122is" should be –122 is–.
Column 12, line 34, delete "s".

Signed and Sealed this

Twenty-third Day of January, 2001

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 6,041,627

DATED : March 28, 2000

INVENTOR(S) : Stuart Buckland

It is certified that error appears in the above-identified patent and that said Letters Patent is hereby corrected as shown below:

On the Title Page, line 11, add --Attorney, Agent or Firm - Paul & Paul--.
Column 3, line 63, "unshaped" should be --u-shaped--.
Column 6, line 32, "1 15" should be --115--.
Column 6, line 39, "1 15" should be --115--

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*

UNITED STATES PATENT AND TRADEMARK OFFICE

CERTIFICATE OF CORRECTION

PATENT NO. : 6,041,627
DATED : March 28, 2000
INVENTOR(S) : Stuart Buckland

It is certified that error appears in the above-identified patent and that said Letters Patent is hereby corrected as shown below:

Title page,
Line 11, add -- Attorney, Agent or Firm - Paul & Paul --.

Column 3,
Line 63, "unshaped" should be -- u-shaped --.

Column 6,
Line 32, "1 15" should be -- 115 --.
Line 39, "1 15" should be -- 115 --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*